US006361620B1

(12) United States Patent
Cicale' et al.

(10) Patent No.: US 6,361,620 B1
(45) **Date of Patent: *Mar. 26, 2002**

(54) PROCESS FOR THE INHIBITION CONTROL IN THE PRODUCTION OF GRAIN-ORIENTED ELECTRICAL SHEETS

(75) Inventors: Stefano Cicale' , Rome; Stefano Fortunati, Ardea; Giuseppe Abbruzzese, Montecastrilli, all of (IT)

(73) Assignee: Acciai Speciali Terni S.p.A., Terni (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/381,104

(22) PCT Filed: Jul. 28, 1997

(86) PCT No.: PCT/EP97/04088

§ 371 Date: Sep. 13, 1999

§ 102(e) Date: Sep. 13, 1999

(87) PCT Pub. No.: WO98/41659

PCT Pub. Date: Sep. 24, 1998

(30) Foreign Application Priority Data

Mar. 14, 1997 (IT) ..... RM97A0146

(51) Int. Cl.[7] ..... H01F 1/04; C21D 8/12

(52) U.S. Cl. ..... 148/113; 148/221; 148/230; 148/231; 148/111

(58) Field of Search ..... 148/221, 230, 148/231, 111, 113

(56) References Cited

U.S. PATENT DOCUMENTS

| | | | | | |
|---|---|---|---|---|---|
| 5,266,129 | A | * | 11/1993 | Minakuchi et al. | 148/113 |
| 5,472,521 | A | * | 12/1995 | Yoshitomi et al. | 148/111 |
| 5,507,883 | A | * | 4/1996 | Tanaka et al. | 148/113 |
| 5,512,110 | A | * | 4/1996 | Yoshitomi et al. | 148/113 |
| 5,597,424 | A | * | 1/1997 | Yoshitomi et al. | 148/111 |
| 5,643,370 | A | * | 7/1997 | Huppi | 148/111 |
| 5,679,178 | A | * | 10/1997 | Komatsubara et al. | 148/113 |
| 5,759,293 | A | * | 6/1998 | Takahashi et al. | 148/111 |
| 5,759,294 | A | * | 6/1998 | Bolling et al. | 148/111 |
| 5,800,633 | A | * | 9/1998 | Inokuti | 148/111 |
| 5,885,371 | A | * | 3/1999 | Komatsubara et al. | 148/113 |

FOREIGN PATENT DOCUMENTS

| | | | |
|---|---|---|---|
| EP | 0339474 | * | 11/1989 |
| EP | 0732413 | * | 9/1996 |

* cited by examiner

*Primary Examiner*—Roy King
*Assistant Examiner*—Nicole Loy
(74) *Attorney, Agent, or Firm*—Hedman & Costigan, P.C.

(57) ABSTRACT

In the production of grain-oriented electrical steel strip, the grain growth inhibition is controlled by balancing the copper, aluminum and carbonium content in order to control the type and quantity of precipitated second phases and obtain optimum grain dimensions during the decarburization annealing. This is done by using a continuous high-temperature thermal treatment in which nitrogen is diffused into the steel strip and aluminum is directly precipitated as aluminum nitride which controls the grain orientation of the final product.

6 Claims, No Drawings

PROCESS FOR THE INHIBITION CONTROL IN THE PRODUCTION OF GRAIN-ORIENTED ELECTRICAL SHEETS

The present application is the national stage filing of and claims priority to International Application No. PCT/EP97/04088, filed Jul. 28, 1997 and Italian Application Serial No. RM97A000146, filed Mar. 14, 1997.

FIELD OF THE INVENTION

The present invention refers to a process for the inhibition control in the production of grain-oriented electrical sheets and, more precisely, it refers to a process by which, through control of copper, aluminium and carbon content, type and quantities of precipitated second phases are determined since the hot-rolled strip, to obtain optimum grain size during the decarburization annealing and some degree of inhibition, thus allowing to carry out a subsequent continuous high-temperature heat treatment in which aluminium as nitride is directly precipitated by diffusing nitrogen along the strip thickness, in order to obtain the second phases ratio necessary to control the grain orientation of the final product.

STATE OF THE ART

Grain-oriented silicon steels for magnetic uses are normally classified into two groups, essentially differentiated by the induction value induced by a magnetic field of 800 As/m and known as "B800": the conventional grain-oriented group, where B800 is lower than 1890 mT, and the high-permeability grain-oriented group, where B800 is higher than 1900 mT. Further subdivisions are depending on the so-called "core-losses", expressed as W/kg.

Conventional grain-oriented steel, used since the 1930's, and grain super-oriented steel, having a higher permeability and industrially used since the second half of the 1960's, are essentially used to realise cores for electric transformers, the advantages of the super-oriented steel rising from its higher permeability (which allows reductions of core sizes) and from its lower losses, which are energy-saving.

The permeability of the sheets depends on the orientation of the body-centred cubic-lattice iron crystals (or grains): one of the grain edges must be parallel to the rolling direction. By using some precipitates (inhibitors), also called "second phases", of suitable sizes and distribution, which reduce grain boundary mobility, a selective growth of the sole grains having the wanted orientation is obtained; the higher the dissolution temperature of said precipitates into the steel, the higher the grain orientation and the better the magnetic characteristics of the final product. Manganese sulphide and/or selenide are the predominant inhibitors in an oriented grain steel, while precipitates including nitrogen linked to aluminium (referred to as "aluminium nitride" for simplicity purposes) are the predominant inhibitors in a super-oriented grain steel.

Nevertheless, when a grain-oriented sheet or a grain super-oriented sheet is produced, during the solidification of steel and the cooling of the solidified body, second phases allowing the above mentioned improving effect are precipitated in coarse form, useless for the wanted purposes; said second phases must be therefore dissolved, reprecipitated in the right form and maintained into said form until the grain having wanted sizes and orientation is obtained at the end of a complicated and expensive transformation process including a cold-rolling at the desired final thickness, a decarburization annealing and a final annealing.

It is evident that the production problems, linked essentially to the difficulties of obtaining high yields and constant quality, are mainly due to the precautions to be taken during the whole transformation process of the steel for maintaining the second phases and, in particular, the aluminium nitride in the wanted form and distribution. In order to relieve said problems, technics have been developed where, the aluminium nitride suitable to control the grain growth is obtained by nitriding the strip, preferably after cold-rolling, as it is disclosed in U.S. Pat. No. 4,225,366 and in European patent n. 0,339,474.

According to the last mentioned patent the aluminium nitride, coarsely precipitated during the slow steel solidification, is maintained into said state by using low slab-heating temperatures (lower than 1280° C., preferably lower than 1250° C.) before the hot-rolling; nitrogen is introduced after the decarburization annealing, which reacts immediately to produce, essentially near the strip surfaces, silicon and manganese/silicon nitrides, having comparatively low solution temperature, which are dissolved during the final annealing in box-annealing furnaces; the nitrogen so released diffuses into the sheet, reacts with the aluminium and precipitates again on the whole strip thickness in a thin and homogeneous form as mixed aluminium and silicon nitrides; said process involves that the material stays at 700–800° C. for at least four hours. The above patent states that nitrogen must be introduced at a temperature near the decarburization one (about 850° C.) and in any case no higher than 900° C. to avoid an uncontrolled grain growth due to the absence of suitable inhibitors. In fact, the optimum nitriding temperature should be of about 750° C., while 850° C. is the upper limit to avoid said uncontrolled growth.

Prima facie the above process has some advantages: relatively low slab-heating temperatures before hot-rolling, decarburation and nitriding, and the fact that no increase in production costs is due to the necessity to maintain the strip at 700–850° C. for at least four hours in the box-annealing furnace (to obtain the mix of aluminium and silicon nitrides required to control the grain growth), as the heating in the box-annealing furnaces in any case requires similar times.

However, together with the above mentioned advantages the above process has some disadvantages as: (i) due to the low slab-heating temperature the sheet includes practically no precipitates inhibiting the grain growth: all the heating steps of the strip, and in particular those belonging to the decarburization and to the nitriding steps, must be taken at comparatively low and critically controlled temperatures, in that at the above conditions grain boundaries are very mobile involving the risk of an uncontrolled grain growth; (ii) the nitrogen introduced is stopped near the strip surfaces as silicon and manganese/silicon nitrides, which must be dissolved to allow the nitrogen diffusion towards the core of the sheet and its reaction for creating the wanted aluminium nitride: as a consequence, no improvement speeding up the heating time can be introduced during the final annealing, for example by using another type of continuous furnace instead of box-annealing ones.

The Applicant, knowing the above difficulties, has developed an improved process which is new and involves a considerable inventive step over the prior art, from which it is distinguished with regard to both the theoretical bases and the process characteristics.

Such process is disclosed by Applicant's copending U.S. applications Ser. Nos. 09/243,000, filed Feb. 26, 1999; 09/242,992, filed Feb. 26, 1999; 09/331,273, filed Jun. 17, 1999; 09/331,506, filed Jun. 22, 1999; and 09/331,504, filed Jun. 22, 1999.

Said patent Applications clearly set forth that the whole process, and in particular the control of the heating temperatures, can be made less critical if some precipitation of inhibitors suitable to control the grain growth is allowed since the hot-rolling step, thus permitting a best control of the grain size during the primary recrystallisation (during the decarburization annealing) and then a deep nitriding of the sheet to directly create aluminium nitride.

In more detail, the process described in said patent applications provides for carrying out said primary recrystallization annealing continuously between 800 and 950° C., in a wet nitrogen-hydrogen atmosphere for a period of time of between 20 and 150 seconds to produce a primary recrystallized strip; continuously nitriding said recrystallized strip at a temperature between 850 and 1050° C. [for a time between 5 and 120 seconds], in a wet nitriding atmosphere comprising ammonia at a level of from 1 to 35 standard liters per kg. of strip and from 0.5 to 100 g/m$^3$ of water vapor.

DESCRIPTION OF THE INVENTION

Object of the present invention is to overcome the disadvantages of the production processes already known and to further improve the technology disclosed by the above mentioned Italian patent Applications by disclosing a process for creating and for controlling, since the hot-rolling step, a system of various inhibitors suitable to make less critical most of the production steps, with particular reference to the careful control of the heating temperature, to obtain optimum grain sizes during the primary recrystallisation and a deep penetration of the nitrogen into the strip to directly form aluminium nitride.

According to the present invention, through a suitable combination of contents of carbon, aluminium and copper it is possible to make easier, according to the innovative technology disclosed by the above mentioned Applicant's Italian patent Applications, the production of silicon steel sheets both of grain-oriented type and of grain super-oriented type.

In particular, according to the invention, the control of the content of copper, carbon and aluminum within the ranges of 800–1800 ppm, 50–550 ppm, 250–350 ppm respectively allows to obtain since the hot-rolled strip thin precipitates and in particular precipitates including nitrogen linked to aluminum and mixed copper+manganese sulfides, apt to give to the sheet an effective inhibition (Iz), between 400 and about 1300 cm$^{-1}$ suitable to control the grain dimensions of the decarburized product.

The effective inhibition is calculated through the empirical formula:

$$Iz=1.91\ Fv/r$$

where Fv is the volume fraction of useful precipitates and r is the mean radius of said precipitates.

Preferably, the copper content is controlled in the 1000–1500 ppm range. The carbon content is preferably in the 50–250 ppm range for a final oriented grain, while it is comprised in the 250–550 ppm range for a final super-oriented grain.

The aluminium content is preferably controlled in the 280–310 ppm range.

Still according to the invention, the continuously cast slabs are heated between 1150° C. and 1320° C., preferably between 1200° C. and 1300° C., and hot-rolled.

Then, the hot-rolled strip is quickly heated to 1100–1150° C., cooled to 850–950° C. left at such temperature for 30–100 s and then quenched from 550–850° C.

The cold-rolling preferably includes passes performed at a temperature comprised between 180 and 250° C.

The final decarburization and nitriding treatments can be performed in various alternative ways, such as:

(i) in a single step, wherein the decarburization is carried out in a wet nitrogen-hydrogen athmosfere, ammonia being added in the final part of the process;

(ii) in a double step, wherein ammonia is added only after having completed the decarburization process, preferably by rising the treatment temperature up to a maximum of 1050° C.;

(iii) in a double step, wherein ammonia is added both after having completed the decarburization process and afterwards, always in the continuous furnace; also in this case it is preferred to rise the treatment temperature up to 1100° C. at the final nitriding stage.

The strip coated with MgO-based annealing separators and coiled, is box-annealed by heating it up to 1210° C. under a nitrogen-hydrogen athmosphere and keeping it for at least 10 h under hydrogen.

The present invention will be now disclosed through some embodiments.

EXAMPLE 1

Two experimental casts were produced having the following composition:

| Cast | Si % weight | C ppm | Mn ppm | S ppm | $Al_S$ ppm | N ppm | Ti ppm | Cu ppm |
|---|---|---|---|---|---|---|---|---|
| 1 | 3.2 | 520 | 1400 | 70 | 290 | 80 | 14 | 1200 |
| 2 | 3.2 | 510 | 1400 | 75 | 280 | 75 | 12 | 200 |

The casts, divided in two groups, respectively heated at 1280° C. and at 1150° C. for 30 minutes, were hot rolled and the strips were annealed according to the following scheme: 1135° C. for 30 s, 900° C. for 60 s, quenching starting from 750° C. After being pickled and sandblast, the strips were cold rolled at a thickness of 0.30 mm, decarburized for 200 s at 870° C. in wet nitrogen-hydrogen and then nitrided at 770 and at 1000° C. for 30 s, by sending into the furnace a mixture of nitrogen-hydrogen containing 10% $NH_3$. The static annealing was performed according to the following scheme: heating from 30 to 1200° C. at 15° C./h in hydrogen 75%-nitrogen 25% and stop at 1200° C. for 20 h in hydrogen. The permeabilities are shown in Table 1:

TABLE 1

| Heat (slab) | T nitr. 870° C. Chem. comp. No. | | T nitr. 1000° C. Chem. comp. No. | |
|---|---|---|---|---|
| ° C. | 1 | 2 | 1 | 2 |
| 1150 | 1925 | 1915 | 1870 | 1690 |
| 1280 | 1930 | 1900 | 1940 | 1890 |

EXAMPLE 2

Two experimental ingots were prepared having the following compositions:

| Cast | Si % weight | C ppm | Mn ppm | S ppm | $Al_S$ ppm | N ppm | Ti ppm | Cu ppm |
|---|---|---|---|---|---|---|---|---|
| 1 | 3.15 | 320 | 1300 | 78 | 300 | 80 | 14 | 1000 |
| 2 | 3.17 | 300 | 1200 | 71 | 310 | 75 | 12 | 200 |

The procedure according to Example 1 was performed up to the cold rolling step; then the strips were decarburized at 870° C. for 100 s and then nitrided at 770 and at 970° C., to obtain a nitrogen total amount of about 180 ppm. The final treatments were the same as Example 1.

Table 2 shown the thus obtained permeabilities.

TABLE 2

| Heat (slab) | T nitr. 770° C. Chem. comp. No. | | T nitr. 970° C. Chem. comp. No. | |
|---|---|---|---|---|
| ° C. | 1 | 2 | 1 | 2 |
| 1150 | 1885 | 1910 | 1925 | 1720 |
| 1280 | 1890 | 1900 | 1940 | 1910 |

EXAMPLE 3

The following six industrial casts were produced:

| Cast | Si % weight | C ppm | Mn ppm | S ppm | $Al_S$ ppm | N ppm | Ti ppm | Cu ppm |
|---|---|---|---|---|---|---|---|---|
| 1 | 3.22 | 500 | 1300 | 75 | 300 | 70 | 14 | 1800 |
| 2 | 3.21 | 510 | 1400 | 70 | 310 | 75 | 10 | 1300 |
| 3 | 3.23 | 520 | 1400 | 80 | 310 | 80 | 12 | 800 |
| 4 | 3.20 | 500 | 1500 | 70 | 300 | 78 | 10 | 200 |
| 5 | 3.22 | 510 | 1300 | 80 | 310 | 72 | 12 | 180 |
| 6 | 3.24 | 520 | 1500 | 75 | 315 | 70 | 13 | 190 |

Two groups of slabs thus obtained, the ones having low copper and the ones having the amount of copper according to the invention, were all processed according the following scheme: Slab heating at 1280 for 50 min; hot rolling at 2.1 mm, with admission temperature to the finishing stand of 1050° C.; cooling of the strip starting immediately after the exit from the finishing stand; coiling at 580° C.; annealing at 1135° C. for 30 s, and at 900° C. for 120 s. followed by quenching; cold rolling at 0.30 mm; decarburization at 870° C. for 220 s in wet nitrogen-hydrogen and nitriding at 1000° C. for 30 s by sending into the furnace a mixture of nitrogen-hydrogen containing 10% ammonia by volume; final box-annealing with heating of 15° C./h up to 1200° C. in nitrogen-hydrogen 75:25, and stop at 1200° C. for 20 h in hydrogen.

Table 3 shows the thus obtained permeabilities.

TABLE 3

| B800 (mT) | low copper No. (strips) | high copper No. (strips) |
|---|---|---|
| 1880–1890 | 2 | — |
| 1890–1900 | 5 | — |
| 1900–1910 | 9 | — |
| 1910–1920 | 7 | 4 |
| 1920–1930 | 3 | 20 |

TABLE 3-continued

| B800 (mT) | low copper No. (strips) | high copper No. (strips) |
|---|---|---|
| 1930–1940 | — | 3 |
| 1940–1950 | — | — |

EXAMPLE 4

A steel having the following composition was cast: Si 3.22% by weight, C 500 ppm, Mn 1300 ppm, S 75 ppm, $Al_s$ 300 ppm, N 70 ppm, Ti 14 ppm, Cu 1200 ppm. The slabs were heated at 1150° C. and then hot rolled; part of the strips was cooled immediately after the exit from the finishing stand, the remaining strips were subjected to a cooling which started with a delay of 6 seconds from the finishing stand exit; such strips were marked Standard Cooling (SC) and Delayed Cooling (DC) respectively.

A SC strip and a DC strip were annealed at 1130° C. for 30 s and then at 900° C. for 60 s. Afterwards all the strips were cold rolled at a thickness of 0.27 mm, decarburized and continuously nitrided in in a two zones furnace, namely decarburization at 870° C. for 220 s in wet nitrogen-hydrogen, and nitriding at 1000° C. for 30 s, by supplying into the furnace a mixture of nitrogen-hydrogen containing 10% ammonia by volume, and having a dew point of 10° C.

The final treatments were those described in Example 1. The thus obtained magnetic features are shown in Table 4.

TABLE 4

| | standard cooling | | delayed cooling | |
|---|---|---|---|---|
| | P17 (W/kg) | B800 (mT) | P17 (W/kg) | B800 (mT) |
| Annealed strip | 0.90 | 1930 | 0.91 | 1920 |
| non annealed strip | 1.98 | 1656 | 0.90 | 1925 |

What is claimed is:

1. Process for the inhibition control in the production of grain-oriented electrical sheets where a silicon steel is cast in slabs, then brought to high temperature and hot-rolled; and the thus obtained hot-rolled strip is annealed and quenched, cold-rolled and the thus obtained cold-rolled strip is subjected to primary recrystallization annealing, nitrided and then subjected to secondary recrystallization annealing, said process being characterized by the combination in cooperative relationship of the following steps:

(i) continuously casting a silicon steel having a content of copper, carbon and aluminum respectively in the following ranges 800–1800 ppm, 50–500 ppm, 250–350 ppm;

(ii) heating the continuously cast slabs at a temperature comprised between 1150 and 1320° and hot-rolling them;

(iii) bringing the thus obtained strip to 1100–1150° C., cooling it to 850–950° C., keeping it at this temperature for 30–100 s and then quenching it from 550–850° C. in order to obtain a strip in which the effective inhibition (Iz) for controlling grain growth, calculated according to the empirical formula:

$$Iz=1.91\ Fv/r$$

where Fv is the volume fraction of the useful precipitates and r is the mean radius of said precipitates, ranges between 400 and 1300 $cm^{-1}$; and (iv) carrying out said primary recrystallization annealing continuously between 800 and 950° C., in a wet nitrogen-hydrogen atmosphere for a period of time of between 20 and 150 seconds to produce a primary recrystallized strip; and then continuously nitriding said recrystallized strip at a temperature between 850 and 1050° C. [for a time between 5 and 120 seconds], in a wet nitriding atmosphere comprising ammonia at a level of from 1 to 35 standard liters per kg. of strip and from 0.5 to 100 $g/m^3$ of water vapor.

2. Process according to claim 1, wherein the copper amount ranges between 1000 and 1500 ppm.

3. Process according to claim 1, wherein for an oriented grain final product, the carbon amount ranges between 50 and 250 ppm.

4. Product according to claim 1, wherein for a super-oriented grain final product, the carbon amount ranges between 250 and 550 ppm.

5. Process according to claim 1, wherein the aluminum amount ranges between 280 and 310 ppm.

6. Process according to claim 1, wherein the step of cold-rolling is at a temperature ranging between 180 and 250° C.

* * * * *